US006394176B1

(12) United States Patent
Marsais

(10) Patent No.: US 6,394,176 B1
(45) Date of Patent: May 28, 2002

(54) COMBINED HEAT EXCHANGER, PARTICULARLY FOR A MOTOR VEHICLE

(75) Inventor: Christian Marsais, Grosrouvre (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/442,281

(22) Filed: Nov. 19, 1999

(30) Foreign Application Priority Data

Nov. 20, 1998 (FR) ..... 98 14655

(51) Int. Cl.[7] ..... F28D 7/10

(52) U.S. Cl. ..... 165/140; 165/134.1; 165/135; 165/136; 165/916; 165/174; 165/153

(58) Field of Search ..... 165/140, 173, 165/174, 175, 916, 153, 177, 134.1, 135, 136

(56) References Cited

U.S. PATENT DOCUMENTS

| | | | | | |
|---|---|---|---|---|---|
| 2,037,845 | A | * | 4/1936 | Young | 165/140 X |
| 2,264,820 | A | * | 12/1941 | Young | 165/140 |
| 2,505,790 | A | * | 5/1950 | Panthofer | 165/140 |
| 3,447,596 | A | * | 6/1969 | Hughes | 165/140 |
| 4,651,816 | A | * | 3/1987 | Struss et al. | 165/140 X |
| 4,923,001 | A | * | 5/1990 | Marcolin | 165/140 |
| 4,947,931 | A | * | 8/1990 | Vitaceo | 165/140 X |
| 4,998,580 | A | * | 3/1991 | Guntly et al. | 165/173 X |
| 5,186,244 | A | | 2/1993 | Joshi | |
| 5,303,770 | A | * | 4/1994 | Dierbeck | 165/140 |
| 5,341,870 | A | * | 8/1994 | Hughes et al. | 165/110 |
| 5,372,188 | A | * | 12/1994 | Dudley et al. | 165/110 |
| 5,526,873 | A | * | 6/1996 | Marsars et al. | 165/140 X |
| 5,743,328 | A | | 4/1998 | Sasaki et al. | |
| 5,894,885 | A | * | 4/1999 | Paquet | 165/149 |
| 6,035,927 | A | * | 3/2000 | Krauss et al. | 165/135 |
| 6,062,303 | A | * | 5/2000 | Ahn et al. | 165/174 X |

FOREIGN PATENT DOCUMENTS

| | | | | |
|---|---|---|---|---|
| DE | 1088027 | * | 9/1960 | 165/166 |
| DE | 94 01 035.8 | | 5/1995 | |
| EP | 0 361 358 | | 4/1990 | |
| EP | 0 773 419 | | 5/1997 | |
| GB | 2262600 | * | 6/1993 | 165/140 |

* cited by examiner

*Primary Examiner*—Christopher Atkinson
(74) *Attorney, Agent, or Firm*—Morgan & Finnegan, LLP

(57) ABSTRACT

A motor vehicle combined heat exchanger has a tube bank linked to two manifolds and divided into an oil cooler having tubes for oil, and a condenser having tubes for a cooling fluid. The two types of tubes are different and possess respective hydraulic diameters related by the following inequality:

$$0.8\ mm^2 \leq DHa \times DHb \leq 3.00\ mm^2$$

where the hydraulic diameter (DH) of a tube is defined by the formula DH=4S/P, in which S designates the area of the internal cross-section of the tube (expressed in $mm^2$) and P the internal perimeter, or "wet perimeter", of the tube (expressed in mm).

20 Claims, 1 Drawing Sheet

COMBINED HEAT EXCHANGER, PARTICULARLY FOR A MOTOR VEHICLE

FIELD OF THE INVENTION

The invention relates to a combined heat exchanger, particularly for a motor vehicle, including a bank of tubes linked to manifolds and divided into two parts capable of being traversed by different fluids.

BACKGROUND OF THE INVENTION

In a heat exchanger of this type, the two fluids are cooled by the same airflow which sweeps through the bank.

The invention relates more particularly to a combined heat exchanger in which the bank of tubes is divided into a part forming an oil cooler, the tubes of which are suitable for being traversed by oil, and into a part forming a condenser, the tubes of which are suitable for being traversed by a cooling fluid.

In such a heat exchanger, the oil is typically the transmission oil, in particular for an automatic gearbox of a motor vehicle. As for the condenser, it serves to cool the cooling fluid for a motor vehicle air-conditioning installation.

At the present time, the cooling of the cooling fluid and the cooling of the transmission oil are carried out by two separate exchangers, usually a parallel-flow condenser and an oil exchanger, of the vane type, placed in proximity to the condenser.

It is known, moreover, according to the Japanese Utility Model No. 61-167202 to produce a combined heat exchanger comprising a part forming a condenser and a part forming a heat exchanger. This heat exchanger comprises a common bank of tubes linked to two tubular manifolds.

The production of a combined heat exchanger, including a part forming an oil cooler and a part forming a condenser, poses many problems because the two fluids exhibit very different characteristics. Thus, the viscosity of the oil is very much greater than that of the coolant and the loss of pressure head in the oil is therefore very high.

Moreover, the two fluids circulate at very different temperatures, that of the oil being very much higher than that of the cooling fluid. These substantial temperature differences are capable of engendering differential-expansion phenomena which may damage the heat exchanger and lead to leakage.

Moreover, it may happen that the cooling fluid is heated by the oil, which then leads to a degradation in performance of the condenser part.

The invention aims to afford a solution to the above problems.

SUMMARY OF THE INVENTION

According to the present invention there is provided a combined heat exchanger including a bank of tubes linked to manifolds and divided into a part forming an oil cooler, the tubes of which are suitable for being traversed by oil, and into a part forming a condenser, the tubes of which are suitable for being traversed by a cooling fluid, wherein the tubes of the oil-cooler part and the tubes of the condenser part are different and possess respective hydraulic diameters related by the following inequality:

$$0.8\ \text{mm}^2 \leqq DHa \times DHb \leqq 3.00\ \text{mm}^2$$

where the hydraulic diameter DH of a tube is defined by the formula DH=4S/P, in which S designates the area of the cross-section of the tube (expressed in $mm^2$) and P the internal perimeter, or "wet perimeter", of the tube (expressed in mm).

Hence, the combined heat exchanger of the invention comprises different tubes, that is to say that the tubes of the condenser part are adapted to the circulation of the cooling fluid, whereas the tubes of the oil-cooler part are adapted to the circulation of the oil.

Moreover, it is essential for the product of the respective hydraulic diameters DHa and DHb to satisfy the foregoing inequality relationship. This is because it has been observed that when the product DHa×DHb is greater than 3.00 mm, the thermal power exchange within each of the two fluids drops off significantly. Moreover, when this product is less than 0.8 $mm^2$, the loss of pressure head in the oil circuit increases vary greatly.

In the invention, the tubes of the bank are advantageously multi-channel tubes.

The hydraulic diameter of the tubes of the oil-cooler part is preferably greater than the hydraulic diameter of the tubes of the condenser part.

It is particularly advantageous for the number of channels of the tubes of the oil-cooler part to be less than the number of channels of the tubes of the condenser part. This means, in other words, that the tubes of the oil-cooler part contain fewer partitions than the tubes of the condenser part. This makes it possible to increase the hydraulic diameter and thus significantly to lower the loss of pressure head generated by the circulation of the oil in these tubes.

The tubes of the bank are advantageously obtained by extrusion.

According to another characteristic of the invention, the tubes of the bank are linked to two manifolds each of which includes a separating partition for isolating the oil circulating in the oil-cooler part and the cooling fluid circulating in the condenser part.

Taking into account the differences in temperatures between these two fluids, there is a benefit in using partitions forming thermal insulation.

According to yet another characteristic of the invention, the heat exchanger comprises means forming a thermal barrier between the tubes of the oil-cooler part and the tubes of the condenser part.

These means make it possible to limit the stresses due to the phenomena of differential expansion and to prevent the cooling fluid being heated by the oil, which is at a very much higher temperature.

In one embodiment of the invention, the means forming a thermal barrier comprise a tube of the bank, called "inactive tube" or "dead tube", which is not traversed by any fluid and which opens out between double partitions of each of the manifolds.

In another embodiment of the invention, in which corrugated spacers are provided between the tubes of the bank, the thermal-barrier forming means comprise a region devoid of corrugated spacers, which extends between two adjacent tubes belonging respectively to the oil-cooler part and to the condenser part.

According to another characteristic of the invention, the bank and the manifolds are assembled by brazing.

Hence, the combined heat exchanger of the invention can be produced according to the well-known technology of brazed exchangers, such as that used, for example, in the production of the condensers.

BRIEF DESCRIPTION OF THE DRAWINGS

In the description which follows, given by way of example, reference will be made to the attached drawings, in which.

DESCRIPTION OF THE PREFERRED EMBODIMENTS

Figure 1:
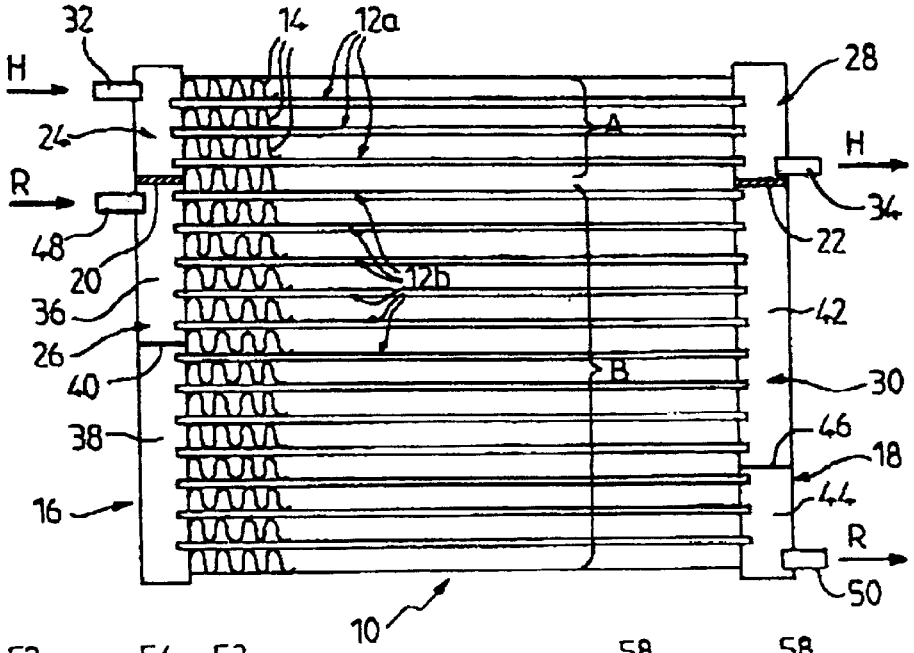
FIG. 1 is a view in longitudinal section of a combined heat exchanger according to a first embodiment of the invention.

In the various figures, like reference numerals refer to like parts.

The combined heat exchanger represented in FIG. 1 comprises a bank 10, also called core, consisting of a multiplicity of tubes 12 extending parallel to each other and between which are arranged corrugated spacers 14 forming cooling fins. The ends of the tubes 12 open out, at one end, into a common manifold 16 and, at the other end, into another common manifold 18. These two manifolds are of tubular configuration and extend parallel to each other.

The various components of the heat exchanger, that is to say the tubes 12, the fins and the manifolds 16 and 18 are made of metal and assembled together by brazing.

The bank is divided into two parts, namely a part A forming an oil cooler and consisting of tubes 12*a* and a part B forming a condenser and consisting of tubes 12*b*. The tubes 12*a* are suitable for being traversed by oil H, such as the transmission oil for a motor-vehicle automatic gearbox. The tubes 12*b* are suitable for being traversed by a cooling fluid R of a motor vehicle air-conditioning installation. It will be understood that these two fluids circulate in two different parts of the bank and are intended to be swept by the same airflow which sweeps over the bank 10.

The manifolds 16 and 18 include respective insulating partitions 20 and 22 for insulating the two fluids from one another.

The partition 20 divides the manifold 16 into a compartment 24 for the oil (here placed in the upper part) and a compartment 26 for the cooling fluid (here placed in the lower part). Correspondingly, the partition 22 divides the manifold 18 into a compartment 28 for the oil (here placed in the upper part) and a compartment 30 for the cooling fluid (here placed in the lower part).

The oil to be cooled enters the compartment 24 through an entry pipe 32, then flows in the tubes 12*a* by parallel flow so as to reach the compartment 28. It then leaves the compartment 28 through an outlet pipe 34.

The compartment 26 is itself divided into two parts, namely an upper part 36 and a lower part 38, by a partition 40. Likewise, the compartment 30 of the manifold 18 is divided into two parts, namely an upper part 42 and a lower part 44, by a partition 46. The cooling fluid R enters the compartment 36 through a entry pipe 48, flows in a part of the tubes 12*b* so as to reach the compartment 42, then flows in the opposite direction to reach the compartment 38. Next, the cooling fluid reaches the compartment 44, flowing again in the reverse direction, and leaves the heat exchanger through an outlet pipe 50. Hence, in this example, the cooling fluid R flows alternately according to a three-pass mode.

Figure 2:
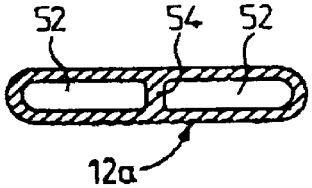
FIG. 2 is a view in section, on an enlarged scale, of a tube of the oil-cooler part.
Figure 3:
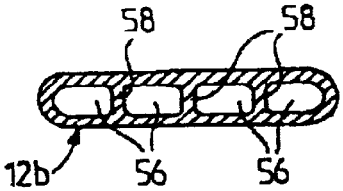
FIG. 3 is a view in section, on an enlarged scale, of a tube of the condenser part.

It is important for the separating partitions 20 and 22 to constitute thermal insulation given that the oil H is at a temperature very much higher than that of the cooling fluid R. The tubes 12*a* and 12*b* (FIGS. 2 and 3) are flat, multi-channel tubes, obtained by extrusion from an appropriate metal alloy, generally aluminum based.

In the example, each tube 12*a* (FIG. 2) includes two channels 52 separated by a partition 54, whereas each tube 12*b* (FIG. 3) includes four channels 56 separated by three partitions 58.

However, the tubes 12*a* and 12*b* have the same outer cross-section, which allows standardization of manufacture, in the sense that the ends of the tubes are accommodated in identical holes formed in the manifolds 16 and 18.

The tubes 12*a* and 12*b* have hydraulic diameters DH of DHa and DHb respectively.

It will be recalled here that the hydraulic diameter DH of a tube is defined by the formula DH=4S/P, in which S designates the internal cross-section of the tube (expressed here in $mm^2$) and P the internal perimeter, also called "wet perimeter", of the tube (here expressed in mm).

The tubes 12*a* and 12*b* thus have specific characteristics making it possible to adapt them respectively to the cooling of the oil and to the cooling of the cooling fluid. Because the tubes 12*a* have fewer channels (and thus fewer partitions) than the tubes 12*b*, the hydraulic diameter of the tubes 12*a* is increased, which makes it possible significantly to lower the loss of pressure head generated by the flowing of the oil in the tubes 12*a*.

In accordance with the invention, the product DHa×DHb takes a value which falls in an interval defined by the following inequality:

$$0.8\ mm^2 \leq DHa \times DHb \leq 3.00\ mm^2$$

When this inequality is satisfied, a combined heat exchanger is obtained in which the thermal power exchanged in terms of each of the two fluids is optimal, while limiting the loss of pressure head of the oil circuit.

As indicated above, because the tubes 12*a* and 12*b* are traversed by fluids at different temperatures, there is a risk of differential-expansion phenomena appearing and generating stresses, particularly in the region of the brazed joints between the tubes and the manifolds.

In the embodiment of FIG. 1, partitions 20 and 22 are provided which are particularly good insulators and which, advantageously, may be double partitions.

Figure 4:
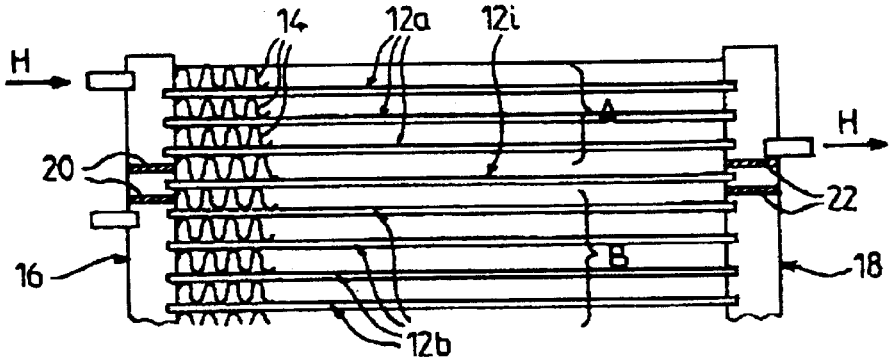
FIG. 4 is a partial view in longitudinal section of a combined exchanger according to a second embodiment of the invention.

Referring now to FIG. 4, another embodiment of the invention is shown with means forming a thermal barrier between the tubes 12*a* and the tubes 12*b*.

In this embodiment, the bank 10 includes an inactive tube 12*i*, also called "dead tube", which is not traversed by any fluid and which opens out between a double partition 20 of the manifold 16 and a double partition 22 of the manifold 18.

Figure 5:
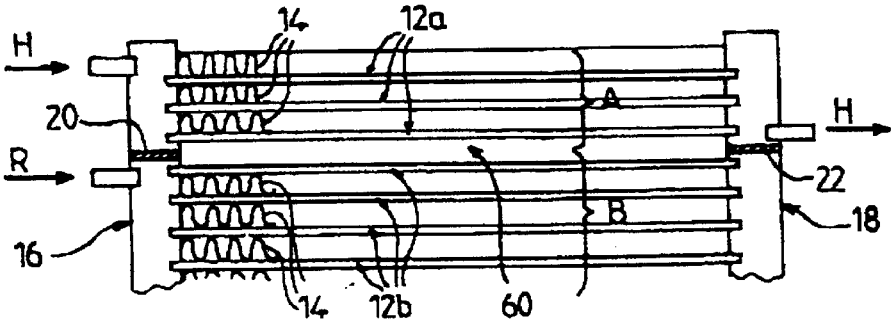
FIG. 5 is a partial view in longitudinal section of an exchanger of the combined heat exchanger according to a third embodiment of the invention.

The heat exchanger of FIG. 5 includes other means forming a thermal barrier. To that end, the bank is configured in such a way as to include a region 60 devoid of corrugated spacers, which extends between the parts A and B of the bank, that is to say between two adjacent tubes 12*a* and 12*b* belonging to these two parts A and B.

In one embodiment, the tubes 12*a* and 12*b* each have a length of 600 mm. The hydraulic diameter DHa of each of the tubes 12*a* is equal to 1.6, while the hydraulic diameter DHb of each of the tubes 12*b* is equal to 1.313, the product DHa×DHb thus being equal to 2.1.

Obviously, the invention is not limited to the embodiments described above and extends to other variants.

I claim:

1. A combined heat exchanger including:

two manifolds; and a bank of tubes linking the manifolds, the combined heat exchanger divided into an oil cooler part, the tubes of which are suitable for being traversed by oil, and into a condenser part, the tubes of which are suitable for being traversed by a cooling fluid, wherein the tubes of the oil-cooler part and the tubes of the condenser part have different hydraulic diameters related by the following inequality:

$$0.8\ mm^2 \leqq DHa \times DHb \leqq 3.00\ mm^2$$

where the hydraulic diameter DH of a tube is defined by the formula DH=4S/P, in which S designates the area of the cross-section of the tube (expressed in $mm^2$) and P the internal perimeter of the tube (expressed in mm).

2. The heat exchanger of claim 1, wherein the tubes of the bank have at least two channels.

3. The heat exchanger of claim 1, wherein the hydraulic diameter of the tubes of the oil-cooler part is greater than the hydraulic diameter of the tubes of the condenser part.

4. The heat exchanger of claim 2, wherein the channels of the tubes of the oil-cooler part are lesser in number than the channels of the tubes of the condenser part.

5. The heat exchanger of claim 1, wherein the tubes of the bank are obtained by extrusion.

6. The heat exchanger of claim 1, wherein the manifolds include a separating partition for isolating the oil circulating in the oil-cooler part and the cooling fluid circulating in the condenser part.

7. The heat exchanger of claim 1, wherein a thermal barrier is provided between the tubes of the oil-cooler part and the tubes of the condenser part.

8. The heat exchanger of claim 7, wherein the thermal barrier comprises an inactive tube of the bank, the inactive tube not traversed by any fluid and opening between separating partitions of the manifolds.

9. The heat exchanger of claim 7, wherein corrugated spacers are provided between the tubes of the bank, and wherein the thermal-barrier comprises a region devoid of corrugated spacers, the region extending between two adjacent tubes belonging respectively to the oil-cooler part and to the condenser part.

10. The heat exchanger of claim 1, wherein the bank of tubes and the manifolds are assembled by brazing.

11. A combined heat exchanger comprising:

two manifolds, each of the manifolds having a first part and a second part; and a bank of tubes respectively linking the first parts of the manifolds and the second parts of the manifolds, wherein a first group of tubes for a first fluid link the first parts and a second group of tubes for a second fluid link the second parts, wherein the tubes of the first group and the tubes of the second group have different hydraulic diameters related by the inequality:

$$0.8\ mm^2 \leqq DH_{first} \times DH_{second} \leqq 3.00\ mm^2$$

wherein DH is the hydraulic diameter of a tube as defined by DH=4S/P, in which S is the cross-sectional area of the tube (in $mm^2$) and P is the internal perimeter of the tube (in mm).

12. The heat exchanger of claim 11, wherein each tube of the bank has at least 2 channels.

13. The heat exchanger of claim 11, wherein the hydraulic diameter of the tubes of the first group is greater than the hydraulic diameter of the tubes of the second group.

14. The heat exchanger of claim 12, wherein the tubes of the first group have a lesser number of channels than the tubes of the second group.

15. The heat exchanger of claim 11, wherein the tubes of the bank are formed by extrusion.

16. The heat exchanger of claim 11, wherein each of the manifolds includes a separating partition that isolates the first fluid in the first part and the second fluid in the second part.

17. The heat exchanger of claim 11, further including:

a thermal barrier between the first group of tubes and the second group of tubes.

18. The heat exchanger of claim 17, wherein the thermal barrier comprises an inactive tube of the bank, the inactive tube not traversed by the first fluid or the second fluid.

19. The heat exchanger of claim 17, wherein corrugated spacers are provided between the tubes of the bank, and wherein the thermal barrier comprises a region devoid of corrugated spacers, the region extending between adjacent tubes belonging respectively to the first group and to the second group.

20. The heat exchanger of claim 11, wherein the manifolds and the bank of tubes are assembled together by brazing.

* * * * *